US011771203B2

(12) United States Patent
Ok

(10) Patent No.: US 11,771,203 B2
(45) Date of Patent: Oct. 3, 2023

(54) COSMETIC CONTAINER HAVING REPLACEABLE CARTRIDGES

(71) Applicant: Soo Jeong Ok, Busan (KR)

(72) Inventor: Soo Jeong Ok, Busan (KR)

( * ) Notice: Subject to any disclaimer, the term of this patent is extended or adjusted under 35 U.S.C. 154(b) by 925 days.

(21) Appl. No.: 16/536,682

(22) Filed: Aug. 9, 2019

(65) Prior Publication Data

US 2020/0060409 A1 Feb. 27, 2020

(30) Foreign Application Priority Data

Aug. 22, 2018 (KR) ..... 10-2018-0097908

(51) Int. Cl.
*A45D 40/24* (2006.01)
*A45D 40/00* (2006.01)

(52) U.S. Cl.
CPC ..... *A45D 40/24* (2013.01); *A45D 2040/0025* (2013.01); *A45D 2200/052* (2013.01)

(58) Field of Classification Search
CPC .. A45D 33/003; A45D 33/006; A45D 33/008; A45D 33/16; A45D 33/18; A45D 33/20; A45D 33/22; A45D 33/24; A45D 33/26; A45D 33/28; A45D 40/00; A45D 40/06; A45D 40/24; A45D 40/18; A45D 2040/0025; A45D 2040/208; A45D 2200/052; A45D 2200/25; A45C 11/008
USPC ..... 132/314, 315, 294, 295, 296, 303; 220/23.89, 23.87, 23.26; 206/581, 223, 206/276
See application file for complete search history.

(56) References Cited

U.S. PATENT DOCUMENTS 2,533,507 A * 12/1950 Risberg ..... A45D 33/28 206/229
4,679,692 A * 7/1987 Davey ..... A45D 40/00 206/823
5,025,817 A * 6/1991 Wen ..... A45D 33/006 206/823
5,178,478 A * 1/1993 Ryder ..... A45D 40/18 401/195
5,715,848 A * 2/1998 Conley, Jr. ..... A45D 33/28 132/297
7,712,914 B2 * 5/2010 Levy ..... F21V 33/0004 362/136

* cited by examiner

*Primary Examiner* — Cris L. Rodriguez
*Assistant Examiner* — Karim Asqiriba
(74) *Attorney, Agent, or Firm* — IPLA P.A.

(57) ABSTRACT

A cosmetic container system comprises: a first elongate piece having a lengthwise penetration opening and defined by a circular lower periphery and a main periphery extending from the circular lower periphery, wherein the main periphery has at least two elongate openings each open to the penetration opening, wherein the elongate openings are configured to fittingly, detachably hold cosmetic cartridges each carrying a predetermined cosmetic therein; a second elongate piece rotatably engaged over the main periphery to the lower periphery and having a selection opening to selectively choose the cartridges through the selection opening by rotating the lower periphery against the second elongate piece; and a third elongate piece detachably engaged over the first elongate piece further into the lower periphery, wherein the third elongate piece is at least twice a diameter of the lower periphery in length.

20 Claims, 3 Drawing Sheets

COSMETIC CONTAINER HAVING REPLACEABLE CARTRIDGES

BACKGROUND

This invention relates to a cosmetic container system and, more particularly, to an improved cosmetic container having reusable and replaceable cosmetic cartridges, which could improve convenience, usability, reusability and portability of daily cosmetics while protecting environment from cosmetic wastes.

Our environment suffers from cosmetic waste. It is known that each and every year, the cosmetic industry creates billions of tones of non-recyclable cosmetic plastics just dumped to landfills country by country and this waste continue to emit toxic gas into our atmosphere. Many are attracted to cosmetic products with fancy packaging and cosmetic manufacturers have little option to go around.

An increasing demand on the cosmetic market is an eco-friendly cosmetic product that would minimize environmental pollution.

Another demand is to see an improved cosmetic compact carrying more varieties to choose from in a portable compact with convenience without losing taste of compact cosmetic fashion.

SUMMARY OF THE INVENTION

The present invention is contrived to overcome the conventional disadvantages. Accordingly, an objective of the present invention is to provide a cosmetic container system having replaceable cosmetic cartridges to enable a user to choose cosmetics from more options with ease and convenience.

Another objective is to provide a portable cosmetic compact container in a cylindrical shape different from a traditional flat compact, thus satisfying a market demand for a unique and trendy cosmetic fashion while improving usability and portability.

A still another objective is to provide a portable cosmetic compact container system enabling a user to choose a variety of different cosmetic cartridges by simply rotation the bottom of the cylindrical cosmetic container.

In order to achieve these and other objectives, the present invention provides a cosmetic container system, comprising: a first elongate piece having a lengthwise penetration opening and defined by a circular lower periphery and a main periphery extending from the circular lower periphery, wherein the main periphery has at least two elongate openings each open to the penetration opening, wherein the elongate openings are configured to fittingly, detachably hold cosmetic cartridges each carrying a predetermined cosmetic therein; a second elongate piece rotatably engaged over the main periphery to the lower periphery and having a selection opening to selectively choose the cartridges through the selection opening by rotating the lower periphery against the second elongate piece; and a third elongate piece detachably engaged over the first elongate piece further into the lower periphery, wherein the third elongate piece is at least twice a diameter of the lower periphery in length.

The cosmetic container system may further comprise a bottom cap rotatably attached to the lower periphery of the first elongate piece and a top cap detachably attached to an upper part of the second elongate piece. The third elongate piece is rotatably engaged to the lower periphery of the first elongate piece. A circular groove is formed adjacent to the lower periphery to fittingly receive a circular tongue formed at a lower inner surface of the second elongate piece so as to facilitate rotation of the first elongate piece against the second elongate piece. The elongate openings are each configured to hold up to three of the cosmetic cartridges.

In the cosmetic container system, the system may comprise: a first elongate piece having a lengthwise penetration opening and defined by a circular lower periphery and a main periphery extending from the circular lower periphery, wherein the main periphery has at least two elongate openings each open to the penetration opening, wherein the elongate openings are configured to fittingly, detachably hold cosmetic cartridges each carrying a predetermined cosmetic therein, wherein a first circular groove is formed along the lower periphery, wherein a plurality of first upright teeth are circularly formed along a lower part of the lower periphery; a second elongate piece rotatably engaged over the main periphery to the lower periphery and having a selection opening to selectively choose the cartridges through the selection opening by rotating the lower periphery against the second elongate piece; a third elongate piece detachably engaged over the first elongate piece further into the lower periphery, wherein the third elongate piece is at least twice a diameter of the lower periphery in length; and a bottom cap having a second circular groove formed along an inner surface of the bottom cap to rotatably receive a plurality of first protrusions formed above the first upright teeth, wherein a plurality of second upright teeth are formed below the second circular groove and along the inner surface of the bottom cap to become engaged to the first upright teeth of the first elongate piece.

The third elongate piece is rotatably engaged to the lower periphery of the first elongate piece. The third elongate piece has a second circular groove formed along an inner lower surface thereof to rotatably receive a plurality of second protrusions formed between the first circular groove and the first protrusions of the first elongate piece. A plurality of third protrusions are formed along an upper inner surface of the second elongate piece to elastically fit in rail grooves formed along an upper outer surface of the first elongate piece.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
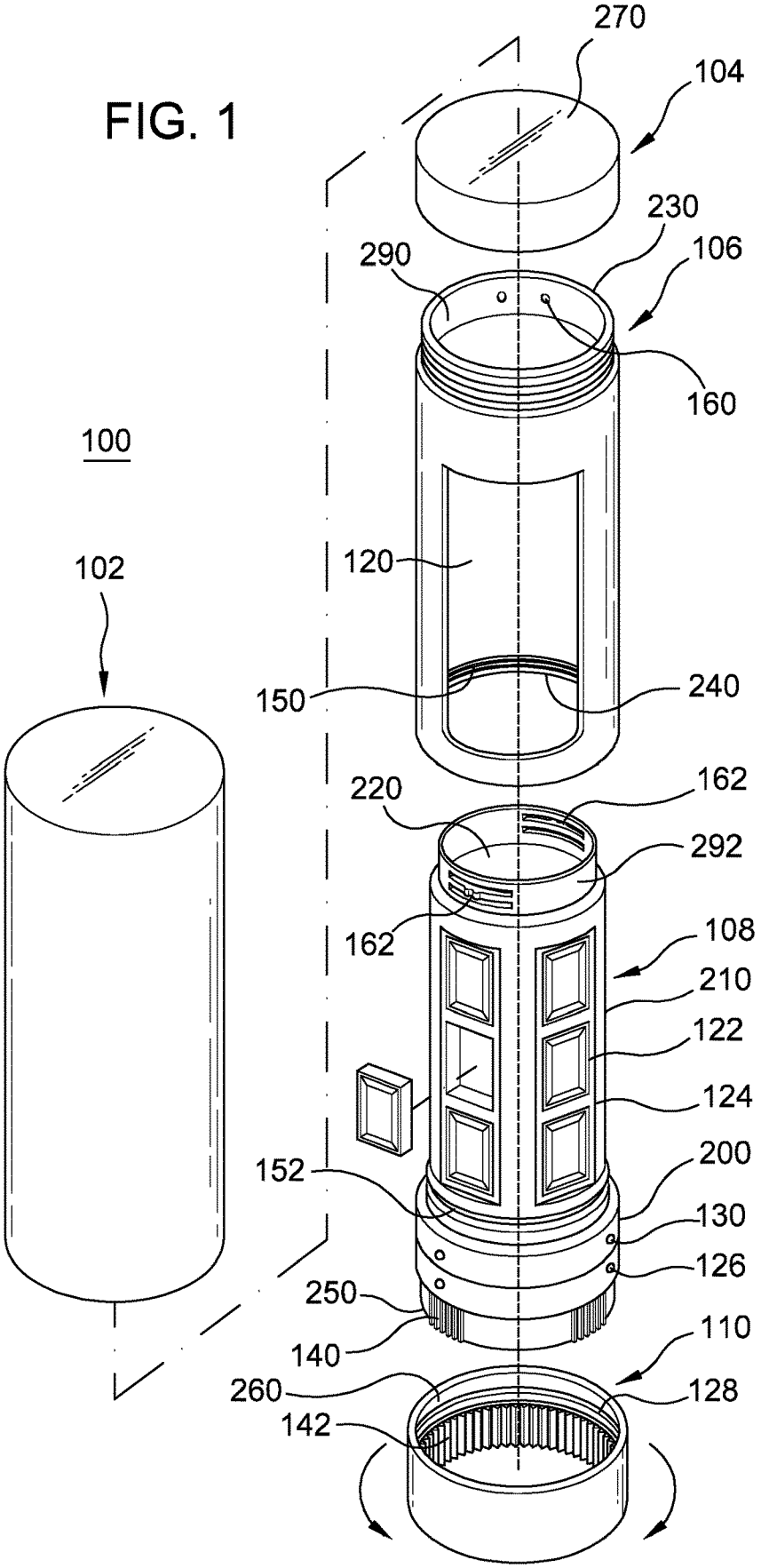
FIG. 1 is an exploded perspective view showing the cosmetic container system according to the present invention.
Figure 2:
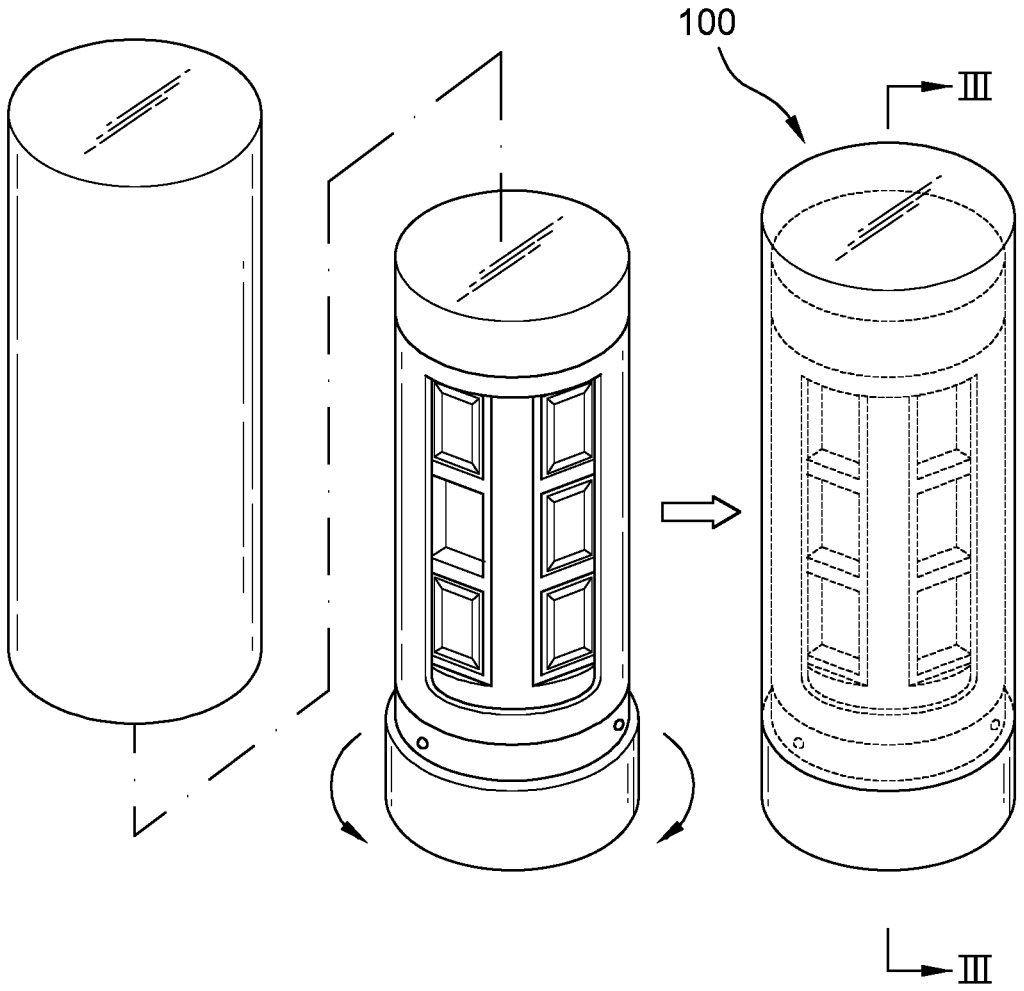
FIG. 2 is an assembly view of the cosmetic container system according to the present invention.
Figure 3:
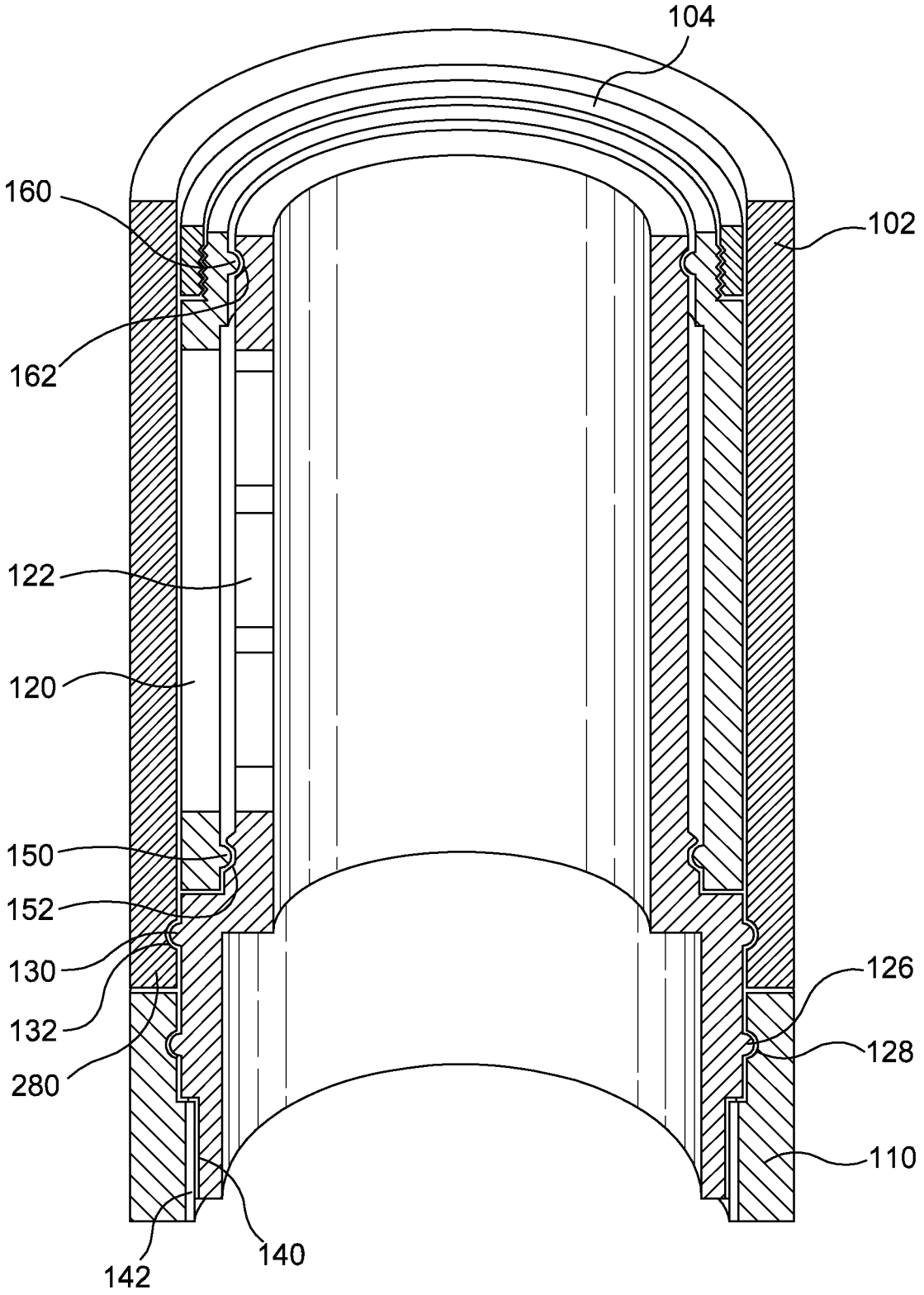
FIG. 3 is a cross section taken along III-III in FIG. 1.

With reference to the drawings, a cosmetic container system 100 according to the present invention comprises a first elongate piece 108 serving as a base body of the container system, a second elongate piece 106 serving as a cover over the base body, and a third elongate piece 102 serving as a removable elongate cover.

The first elongate piece 108 has a lengthwise penetration opening 220 and it may be defined by a circular lower periphery 200 and a main periphery 210 which extends from the circular lower periphery 200 of the first elongate piece 108. In this construction, the main periphery 210 may be provided with at least two elongate openings 124 each open to the penetration opening 220. The elongate openings 124 may be configured to fittingly, detachably hold cosmetic cartridges 122 each carrying a predetermined cosmetic therein.

The second elongate piece 106 may be rotatably engaged over the main periphery 210 to the lower periphery 200. The second elongate piece 106 may have a selection opening 120 to selectively choose the cartridges 122 through the selection opening 120 by rotating the lower periphery 200 against the second elongate piece 106.

The third elongate piece 102 may be detachably engaged over the first elongate piece 108 further into the lower periphery 200 of the first elongate piece 108. The third elongate piece 102 may be at least twice a diameter of the lower periphery 200 of the first elongate piece 108 in length. In a preferred version, the third elongate piece 102 may be three times the diameter of the lower periphery 200 of the first elongate piece 108 in length.

The cosmetic container system 100 may further comprise a bottom cap which may be rotatably attached to the lower periphery 200 of the first elongate piece 108. The cosmetic container system 100 may still further comprise a top cap 104 which may be detachably attached to an upper part 230 of the second elongate piece 106.

Preparedly, the third elongate piece 102 may be rotatably engaged over the second elongate piece 106 to the lower periphery 200 of the first elongate piece 108. A circular groove 152 which will also be referred to as a first circular groove may be formed adjacent to the lower periphery 200 to fittingly receive a circular tongue 150 formed at a lower inner surface 240 of the second elongate piece 106 so as to facilitate rotation of the first elongate piece 108 against the second elongate piece 106. The circular groove 152 may be formed between the main periphery 210 and the lower periphery 200 of the first elongate piece 108. In order increase options for a user to choose, the elongate openings 124 may be each configured to hold up to three of the cosmetic cartridges 122.

In an embodiment, the cosmetic container system 100 may comprise: a first elongate piece 108 having a lengthwise penetration opening 220 and defined by a circular lower periphery 200 and a main periphery 210 extending from the circular lower periphery 200, where the main periphery 200 has at least two elongate openings 124 each open to the penetration opening 220, where the elongate openings 124 are configured to fittingly, detachably hold cosmetic cartridges 122 each carrying a predetermined cosmetic therein, where a first circular groove 152 is formed along the lower periphery 200, where a plurality of first upright teeth 140 are circularly formed along a lower part 250 of the lower periphery 200; a second elongate piece 106 rotatably engaged over the main periphery 210 to the lower periphery 200 and having a selection opening 120 to selectively choose the cartridges 122 through the selection opening 120 by rotating the lower periphery 200 against the second elongate piece 106; a third elongate piece 102 detachably engaged over the first elongate piece 108 further into the lower periphery 200 of the first elongate piece 108, where the third elongate piece 102 may be at least twice a diameter of the lower periphery 200 in length; and a bottom cap 110 having a second circular groove 128 formed along an inner surface 250 of the bottom cap 110 to rotatably receive a plurality of first protrusions 126 formed above the first upright teeth 140, where a plurality of second upright teeth 142 are formed below the second circular groove 128 and along the inner surface 260 of the bottom cap 110 to become engaged to the first upright teeth 140 of the first elongate piece 108.

The top cap 104 may be detachably attached to an upper part 230 of the second elongate piece 106. The third elongate piece 102 may be rotatably engaged to the lower periphery 200 of the first elongate piece 108. The first circular groove 152 may be fittingly configured to rotatably receive therein a circular tongue 150 formed at a lower inner surface 240 of the second elongate piece 106 so as to facilitate rotation of the first elongate piece 108 against the second elongate piece 106. The elongate openings 124 are each configured to hold up to three of the cosmetic cartridges 122.

In a preferred embodiment, the cosmetic container system 100 comprises: a first elongate piece 108 having a lengthwise penetration opening 220 and defined by a circular lower periphery 200 and a main periphery 210 extending from the circular lower periphery 200, where the main periphery 210 has at least two elongate openings 124 each open to the penetration opening 220, where the elongate openings 124 are configured to fittingly, detachably hold cosmetic cartridges 122 each carrying a predetermined cosmetic therein, where a first circular groove 152 is formed along the lower periphery 200, where a plurality of first upright teeth 140 are circularly formed a lower part 250 of the lower periphery 200; a second elongate piece 106 rotatably engaged over the main periphery 210 to the lower periphery 200 and having a selection opening 120 to selectively choose the cartridges 122 through the selection opening 120 by rotating the lower periphery 200 against the second elongate piece 106; a third elongate piece 102 detachably engaged over the first elongate piece 108 further into the lower periphery 200, where the third elongate piece 102 is at least twice a diameter of the lower periphery 200 in length; a top cap 104 detachably attached to an upper part 230 of the second elongate piece 106; and a bottom cap 110 having a second circular groove 128 formed along an inner surface 260 of the bottom cap 110 to rotatably receive a plurality of first protrusions 126 formed above the first upright teeth 140, where a plurality of second upright teeth 142 are formed below the second circular groove 128 and along the inner surface 260 of the bottom cap 110 to become engaged to the first upright teeth 140 of the first elongate piece 108.

The top cap 104 may be detachably threaded to the upper part 230 of the second elongate piece 106. A mirror 270 may be formed on top of the top cap 270 for a better performance. The first circular groove 152 may be fittingly configured to rotatably receive therein a circular tongue 150 formed at a lower inner surface 240 of the second elongate piece 106 so as to facilitate rotation of the first elongate piece 108 against the second elongate piece 106. The elongate openings 124 are each configured to hold up to three of the cosmetic cartridges 122. The cosmetic cartridges 122 may be manually replaceable.

In a preferred version, the third elongate piece 102 may be rotatably engaged to the lower periphery 200 of the first elongate piece 108. The third elongate piece 102 may have a second circular groove 132 formed along an inner lower surface 280 thereof to rotatably receive a plurality of second protrusions 130 formed between the first circular groove 152 and the first protrusions 126 of the first elongate piece 108. A plurality of third protrusions 160 may be formed along an upper inner surface 290 of the second elongate piece 106 to elastically fit in rail grooves 162 formed along an upper outer surface 292 of the first elongate piece 108.

The cosmetic container system 100 may be combined with a custom cartridge pack carrying custom cartridges which can be selectively replaced with the cosmetic cartridges 122 according to the present invention. All of each piece and element provided in the cosmetic container system 100 are readily dissembled and assembled by a user. Therefore, as far as the cartridges 122 are replaced, it can be reused all the time so as to further protect environment from getting polluted by cosmetic compact waste.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cosmetic container system, comprising:

a first elongate piece having a lengthwise penetration opening and defined by a circular lower periphery and a main periphery extending from the circular lower periphery, wherein the main periphery has at least two elongate openings each open to the penetration opening, wherein the elongate openings are configured to fittingly, detachably hold cosmetic cartridges each carrying a predetermined cosmetic therein;

a second elongate piece rotatably engaged over the main periphery to the lower periphery and having a selection opening to selectively choose the cartridges through the selection opening by rotating the lower periphery against the second elongate piece; and a third elongate piece detachably engaged over the first elongate piece further into the lower periphery, wherein the third elongate piece is at least twice a diameter of the lower periphery in length.

2. The cosmetic container system of claim 1, further comprising a bottom cap rotatably attached to the lower periphery of the first elongate piece.

3. The cosmetic container system of claim 1, further comprising a top cap detachably attached to an upper part of the second elongate piece.

4. The cosmetic container of claim 1, wherein the third elongate piece is rotatably engaged to the lower periphery of the first elongate piece.

5. The cosmetic container system of claim 1, wherein a circular groove is formed adjacent to the lower periphery to fittingly receive a circular tongue formed at a lower inner surface of the second elongate piece so as to facilitate rotation of the first elongate piece against the second elongate piece.

6. The cosmetic container system of claim 1, wherein the elongate openings are each configured to hold up to three of the cosmetic cartridges.

7. The cosmetic container system of claim 1, wherein none of the at least two elongate openings extend into the lower periphery.

8. The cosmetic container system of claim 7, wherein the main periphery is circular, wherein the lower periphery has a larger diameter than that of the main periphery.

9. A cosmetic container system, comprising:

a first elongate piece having a lengthwise penetration opening and defined by a circular lower periphery and a main periphery extending from the circular lower periphery, wherein the main periphery has at least two elongate openings each open to the penetration opening, wherein the elongate openings are configured to fittingly, detachably hold cosmetic cartridges each carrying a predetermined cosmetic therein, wherein a first circular groove is formed along the lower periphery, wherein a plurality of first upright teeth are circularly formed along a lower part of the lower periphery;

a second elongate piece rotatably engaged over the main periphery to the lower periphery and having a selection opening to selectively choose the cartridges through the selection opening by rotating the lower periphery against the second elongate piece;

a third elongate piece detachably engaged over the first elongate piece further into the lower periphery, wherein the third elongate piece is at least twice a diameter of the lower periphery in length; and a bottom cap having a second circular groove formed along an inner surface of the bottom cap to rotatably receive a plurality of first protrusions formed above the first upright teeth, wherein a plurality of second upright teeth are formed below the second circular groove and along the inner surface of the bottom cap to become engaged to the first upright teeth of the first elongate piece, wherein each of the first upright teeth is spaced circumferentially from each other around the lower part of the lower periphery, wherein each of the second upright teeth is spaced circumferentially from each other around the bottom cap.

10. The cosmetic container system of claim 9, further comprising a top cap detachably attached to an upper part of the second elongate piece.

11. The cosmetic container system of claim 9, wherein the third elongate piece is rotatably engaged to the lower periphery of the first elongate piece.

12. The cosmetic container system of claim 9, wherein the first circular groove is fittingly configured to rotatably receive therein a circular tongue formed at a lower inner surface of the second elongate piece so as to facilitate rotation of the first elongate piece against the second elongate piece.

13. The cosmetic container system of claim 9, wherein the elongate openings are each configured to hold up to three of the cosmetic cartridges.

14. A cosmetic container system, comprising:

a first elongate piece having a lengthwise penetration opening and defined by a circular lower periphery and a main periphery extending from the circular lower periphery, wherein the main periphery has at least two elongate openings each open to the penetration opening, wherein the elongate openings are configured to fittingly, detachably hold cosmetic cartridges each carrying a predetermined cosmetic therein, wherein a first circular groove is formed along the lower periphery, wherein a plurality of first upright teeth are circularly formed along a lower part of the lower periphery;

a second elongate piece rotatably engaged over the main periphery to the lower periphery and having a selection opening to selectively choose the cartridges through the selection opening by rotating the lower periphery against the second elongate piece;

a third elongate piece detachably engaged over the first elongate piece further into the lower periphery, wherein the third elongate piece is at least twice a diameter of the lower periphery in length;

a top cap detachably attached to an upper part of the second elongate piece; and a bottom cap having a second circular groove formed along an inner surface of the bottom cap to rotatably receive a plurality of first protrusions formed above the first upright teeth, wherein a plurality of second upright teeth are formed below the second circular groove and along the inner surface of the bottom cap to become engaged to the first upright teeth of the first elongate piece, wherein each of the first upright teeth is spaced circumferentially from each other around the lower part of the lower periphery, wherein each of the second upright teeth is spaced circumferentially from each other around the bottom cap.

15. The cosmetic container system of claim 14, wherein the top cap is detachably threaded to the upper part of the second elongate piece.

16. The cosmetic container system of claim 14, wherein a mirror is formed on top of the top cap.

17. The cosmetic container system of claim 14, wherein the first circular groove is fittingly configured to rotatably receive therein a circular tongue formed at a lower inner surface of the second elongate piece so as to facilitate rotation of the first elongate piece against the second elongate piece.

18. The cosmetic container system of claim 14, wherein the elongate openings are each configured to hold up to three of the cosmetic cartridges.

19. The cosmetic container system of claim 14, wherein the cosmetic cartridges are manually replaceable.

20. The cosmetic container system of claim 14, wherein the third elongate piece is rotatably engaged to the lower periphery of the first elongate piece.

* * * * *